US007350466B2

(12) United States Patent
Hendrix

(10) Patent No.: US 7,350,466 B2
(45) Date of Patent: Apr. 1, 2008

(54) ELECTRICITY-INDUCING IMMOBILIZATION CARTRIDGE ATTACHMENT

(76) Inventor: Glen Hendrix, 1503 Auline La., Houston, TX (US) 77055

( * ) Notice: Subject to any disclaimer, the term of this patent is extended or adjusted under 35 U.S.C. 154(b) by 155 days.

(21) Appl. No.: 11/213,204

(22) Filed: Aug. 26, 2005

(65) Prior Publication Data

US 2007/0234924 A1 Oct. 11, 2007

(51) Int. Cl.
*F42B 30/00* (2006.01)

(52) U.S. Cl. ..... 102/502; 361/232

(58) Field of Classification Search ..... 102/502, 102/293, 513, 232, 512; 361/232
See application file for complete search history.

(56) References Cited

U.S. PATENT DOCUMENTS 4,243,036 A * 1/1981 Ott ..... 604/130
5,962,806 A * 10/1999 Coakley et al. ..... 102/502
7,100,514 B2 * 9/2006 LeBourgeois ..... 102/502
7,111,559 B1 * 9/2006 MacLachlan ..... 102/502
2006/0254108 A1 * 11/2006 Park ..... 42/1.08
2006/0279898 A1 * 12/2006 Smith et al. ..... 361/232
2007/0079721 A1 * 4/2007 Webb ..... 102/506

* cited by examiner

*Primary Examiner*—Michael J. Carone
*Assistant Examiner*—Gabriel J Klein
(74) *Attorney, Agent, or Firm*—Egbert Law Offices

(57) ABSTRACT

An attachment to an electricity-inducing immobilization cartridge has a body with a plurality of converging sections, a strike plate affixed at a front end of the body and a plurality of hinges formed on each of the converging sections. The hinges serve to allow the plurality of converging sections to fold when the strike plate contacts a target. A barb is affixed to an inner surface of at least one of the sections so as to be movable from the interior of the body to a location exterior of the body when the strike plate contacts the target. Fasteners are provided within the body so as to maintain the body in a collapsed condition subsequent to the strike plate contacting the target.

15 Claims, 8 Drawing Sheets

ELECTRICITY-INDUCING IMMOBILIZATION CARTRIDGE ATTACHMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to the field of non-lethal weapons for immobilizing a live target. More particularly, the present invention is directed to a contact mechanism which allows the electrical charge from the cartridge to be delivered from the target in a safe and effective manner.

BACKGROUND OF THE INVENTION

Taser and taser-type products have been around for decades. The taser weapon operates by projecting two darts trailing conductive wires. There are disadvantages to the taser system. The optimal distances required for successful use of the weapon are between 3 and 21 feet. Less than 3 feet, the darts are too close together to properly conduct electricity. Beyond 21 feet, the darts are too far apart for both of them to strike the target. The electrical insulation on the wires must remain intact to keep the device from shorting out from entangled wires. Also, the taser is a one-shot weapon. An officer may have to fall back on lethal means to protect himself or others. Worse, a citizen using a taser for home defense may find him or herself at the mercy of a criminal should the one shot fail.

Despite these disadvantages, the taser weapon system has become extremely popular with law enforcement units, particularly in municipalities. The taser is used by hundreds of law enforcement groups and is just beginning a penetration of the international market.

A solution to the above-mentioned problems is to reduce the electronics and power supply to a self-contained cartridge. The development of such a cartridge would allow the weapon to have a greater range and be adapted to a multiple shot format or, at the least, a quickly chambered second or third shot. Such a cartridge is believed to be in development at this time. This cartridge would increase the popularity of the weapon, but it raises other problems.

The size and mass of these cartridges will be greater than that of the simple barb-tipped darts now being used. Depending on the diameter, mass and velocity, the possibility of unintended physical damage, such as bruised kidneys, ruptured spleens and broken bones, becomes quite distinct.

This cartridge will probably range from one to two inches in diameter and weigh between two to four ounces to accommodate the electronics and power source and still be able to be fired from a compressed gas or powder-discharge weapon. Unfortunately, diameters of less than two inches presents another problem. The minimum separation distance for the electric contacts, or barbs, of a taser is four inches in order for the weapon to function properly. Therefore some mechanism is needed to provide this four-inch minimum from a cartridge that is two inches or less in diameter.

The mass of the cartridge presents yet another problem. The currently used darts do not have enough mass to pull the barb shaft loose upon rebound from the surface of the target. A cartridge with a mass of two to four ounces will have this problem. The barb on existing darts could be made more pronounced but you can only go so far with that before the penetration or removal of the darts leave a serious wound.

U.S. Pat. No. 5,831,199, issued to James McNulty, Jr. et al., on Nov. 3, 1998, describes a method for a cartridge-type device to obtain this dimension. Upon contact, the cartridge is anchored by a barb on front of the cartridge while a secondary wire-tethered dart is fired at an angle from the side of the cartridge at a trajectory that will cause it to strike the skin at least several inches away. It is a taser dart inside a taser cartridge. This solution appears to be cumbersome. A switch must be activated upon impact by the cartridge telling the secondary taser dart to fire. However, if the cartridge strikes the body at an outer periphery, the secondary dart could miss altogether.

U.S. Pat. No. 5,962,806, issued to Peter G. Coakly et al., on Oct. 5, 1999 describes a device in which several arms splay outward from the cartridge body. Since these arms are forwardly hinged, then are activated by a forward plunger that propels them around their hinges upon contact with the target, forcing them against the target. These arms (and the plunger) are barbless. The device is supposed to stay attached with an adhesive applied to the plunger. Although sufficient distance between contact points can be obtained with this device, it does not address the problem of the impact of the cartridge. The invention even touts the combination of kinetic energy with the electrical immobility feature as a positive feature.

It is an object of the present invention to provide an attachment for the cartridge to ameliorate the impact of the cartridge.

It is another object of the present invention to provide an attachment for such a cartridge which reliably delivers a sufficient distance between the contact points so that an effective electrical charge can be delivered to a target.

It is a further object of the present invention to provide an attachment for such a cartridge which counteracts the rebound of the cartridge after initial contact so that the cartridge can stay in a proper place on the target.

It is a further object of the present invention to provide an attachment to such a cartridge which is easy to use, relatively inexpensive, and easy to deploy.

These and other objects and advantages of the present invention will become apparent from the reading of the attached specification and appended claims.

BRIEF SUMMARY OF THE INVENTION

The present invention is an attachment to an electrically-inducing immobilization cartridge comprising a plurality of converging sections having a rear end suitable for connection to the cartridge, a strike plate affixed at a front end of the plurality of converging sections, and a hinging means formed on each of the converging sections. The hinging means serves to fold the converging sections when the strike plate contacts a target.

Specifically, in the present invention, the hinging means is a first hinge formed at a front end of the converging section adjacent to the strike plate, a second hinge formed generally centrally along the converging section, and a third hinge formed at a rear end of the converging section. The first hinge folds outwardly when the strike plate contacts the target. The second hinge folds inwardly when the strike plate contacts the target. The third hinge folds outwardly when the strike plate contacts the target.

In the present invention, a spike is affixed to the strike plate and extends longitudinally outwardly therefrom. A conducting means is formed along the plurality of converging sections so as to deliver the electrical charge from the cartridge to the target. A barb is connected to an inner surface of at least one of the converging sections. The conducting means is connected to the barb. The barb moves outwardly from the converging section when the strike plate contacts the target. The converging section has a hole formed therethrough. The barb extends outwardly through this hole when the strike plate contacts the target.

In the present invention, there is a securing means affixed to an interior of the body. The securing means serves to retain the converging sections in the folded arrangement after the strike plate contacts the target. Each of the converging sections includes a first segment having an end connected to the strike plate, and a second segment hingedly connected the first segment. The securing means is a first hook-and-loop material affixed to an inner surface of the first segment and a second hook-and-loop material affixed to an inner surface of the second segment. The first and second hook-and-loop materials are complementary to each other. Additionally, a hook-and-loop material is affixed to a backside of the strike plate while a complementary hook-and-loop material is affixed to an interior of the body. These hook-and-loop materials engage each other after the strike plate contacts the target.

The optimal number of converging sections is eight, but more or less may be employed. The use of eight such sections is large enough to be structurally sound, while small enough to allow a proper radial diameter when attaching to the cartridge. The barb is a curved barb that is attached to the interior of alternate sections so as to point inwardly. The barb is located on the portion of the section hingedly connected to the cartridge near the middle hinge and is electrically contiguous with a conducting lead such as tape, wire or an otherwise disposed conducting material, which runs from the barb to an electrical contact on the cartridge. A hole is located on the portion of the section hingedly connected to the front strike plate the same distance from the middle hinge as the curved barb. The rear portion of these barb segments has a raised thicker portion down the center. The end of this stiffener toward the cartridge seats onto a ledge on the cartridge when the device folds up upon contact with the target. This helps to transmit the force of the cartridge to the barb so as to give greater assurance of the barb penetrating the target.

The hook-and-loop material is formed on the sections between the barbed sections. The sections attach to the cartridge in a slightly arcing manner. They are forced into an arc-shaped slot in the cartridge which stiffen these segments so as to allow the entire device to maintain its shape despite wind pressure, any centripetal forces and acceleration upon firing the cartridge. The hinge at this juncture is also curved and tears from the edges toward the center of the segment when the device folds up. This design feature assures that the device of the present invention can only be used once, even during target practice.

In practice, the attachment of the present invention is secured to the front of the cartridge. The attachment will fold up upon striking a target. The barb on the strike plate affixes the device to the target. The individual sections fold into a flat, circular plane against the target. This circular area has a greater diameter than that of the cartridge, and thus, spreads the force of the impact over a greater area. This lessens the chance of injury to the targeted person or animal. The barbs will protrude through the corresponding holes and affix to the target. The barbs are curved, or angled, so that they are more or less parallel to the trajectory of the tip of the barb at the point of impact. This allows the barb to penetrate the skin and flesh of the target with as little physical damage as possible. When a pair of opposing barbs penetrate at this angle and are locked in place by the hook-and-loop material, it makes it less likely for the device to be dislodged for any reason.

The attachment of the present invention is sized so that opposing barbs or sections are four inches or more apart after impact. This is a sufficient distance for an effective current to travel through the intended target. The hook-and-loop material on the sections, along with the hook-and-loop material on the strike plate, will be forced together so as to lock the barbs in the protruding condition and to keep the attachment, and associated cartridge, from bouncing off the target upon impact. After the central spike has penetrated the target and the front strike plate is in contact with the target, but before the segments have folded, a TEFLON (TM) washer surrounds the spike so as to serve as a rotating slide plate to reduce the torque delivered to the rest of the device. This prevents warpage and possible misalignment of the barbs with their respective openings.

The various components of the present invention can be suitably injection molded. The conductive material, barbs and hook-and-loop material can be attached by automated equipment in an assembly line fashion.

The present invention successfully addresses the issue of impact amelioration, distance between electrical contacts, and rebound. As such, the present invention makes practical the use of a self-contained cartridge for the electrical incapacitation of humans and animals.

DETAILED DESCRIPTION OF THE INVENTION

Figure 1:
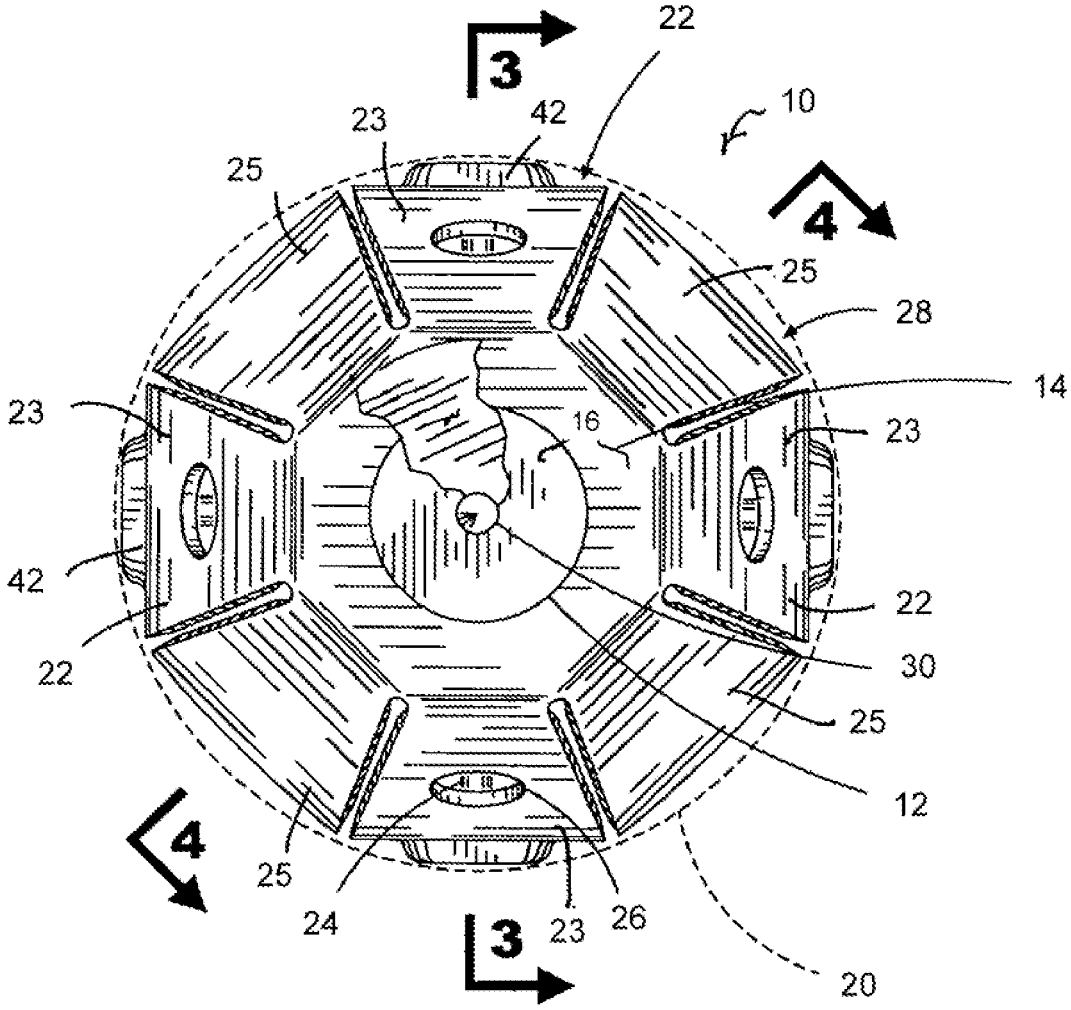
FIG. 1 is a frontal view of the attachment in accordance with the preferred embodiment of the present invention.

Referring to FIG. 1, there is shown the attachment 10 of the present invention that can be secured to an electricity-inducing immobilization cartridge. The illustration of FIG. 1 shows the device 10 in its configuration from the target's point of view. In FIG. 1, it can be seen that the attachment 10 includes eight sections 22. These sections 22 alternate between sections 23 which support the barb and sections 25 which support the hook-and-loop material. Sections 23 and 25 alternate around the periphery of the attachment 10. The sections 23 have a barb 24 (partially illustrated) and a hole 26. A reinforcement 42 is illustrated on sections 23.

In FIG. 1, it can be seen that there is a spike 30 supported on a mounting base 12. The spike 30, along with the mounting base 12 are adhered to a strike plate 14. A teflon washer 16 slides over the spike 30 and rests against the mounting base 12. This teflon washer 16 has a tight running fit on the spike 30. In other words, the washer 16 will not slide on its own but will only rotate about the spike 30 when a force is applied. For example, if the electrical incapacitating cartridge 20 (illustrated in broken line fashion) has rotation while in flight, the washer 16 will serve as a rotating slide plate so as to prevent the spike 30 and the strike plate 14 from imparting enough torque to the sections 22 so as to cause misalignment of the barbs 24 and their associated openings 26. As can be seen in FIG. 1, segments 28 have slight arcuate distortions where they attach to the cartridge 20. This distortion of the segments 28, upon assembly, causes the attachment 10 to be stiff until impact. Otherwise, wind friction, centripetal forces or acceleration can cause the attachment 10 to fold or distort prematurely in flight.

Figure 2:
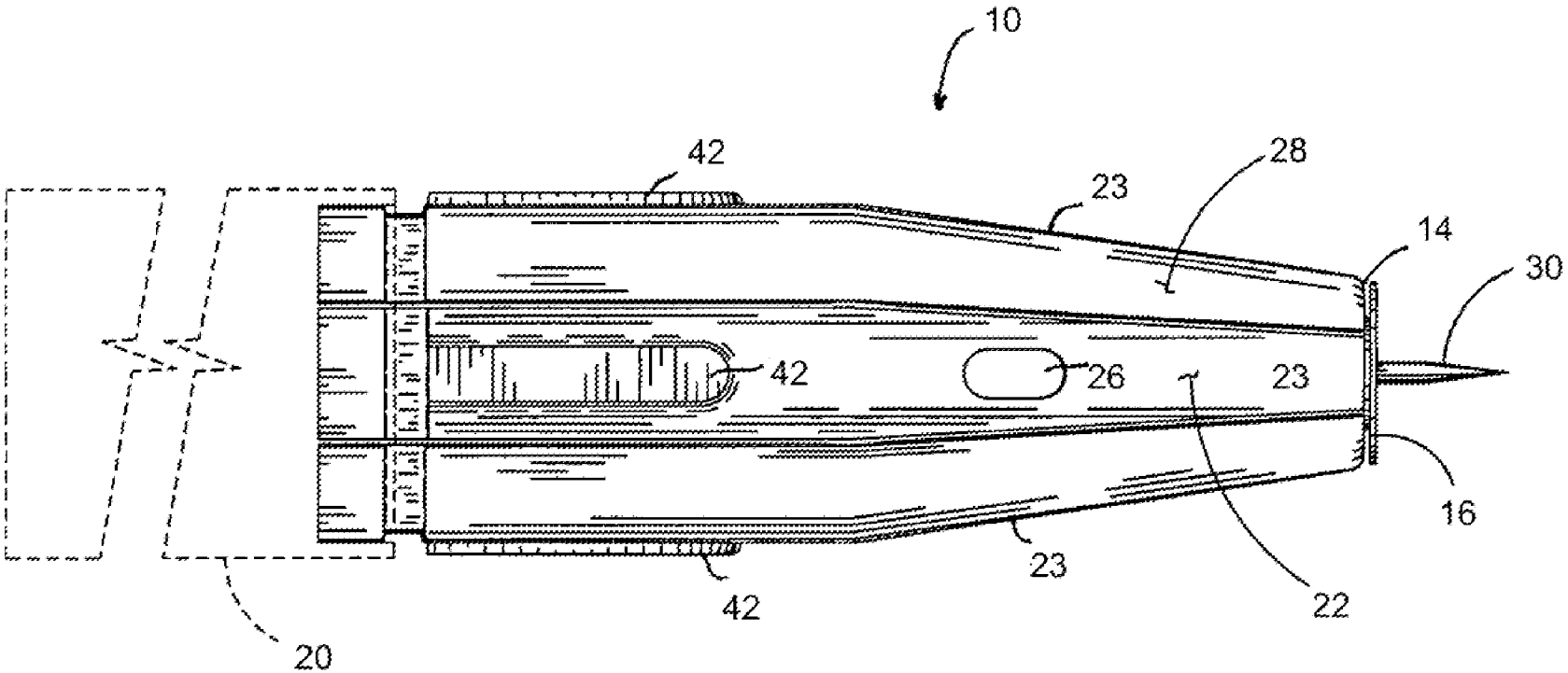
FIG. 2 is a side elevational view of the preferred embodiment of the present invention showing which sections attach to the cartridge and converge toward the front strike plate.

FIG. 2 shows the attachment 10 of the present invention showing, in particular, the arrangement of the sections 22 and 28. The sections 22 and 28 will converge along the length of the attachment 10 toward the strike plate 14. It can further be seen that the spike 30, along with the teflon washer 16 are mounted over the strike plate 14 at the front end of the attachment 10. FIG. 2 further shows how the attachment 10 is secured to the cartridge 20. The barb-supporting sections 23 are illustrated as having reinforcing sections 42 formed on an outer surface thereof. The hole 26 has a generally oval configuration so as to facilitate the ability of the barb to pass therethrough. The attachment 10 assumes a rather aerodynamic configuration because of the arrangement of the various converging sections 22 and 28.

Figure 3:
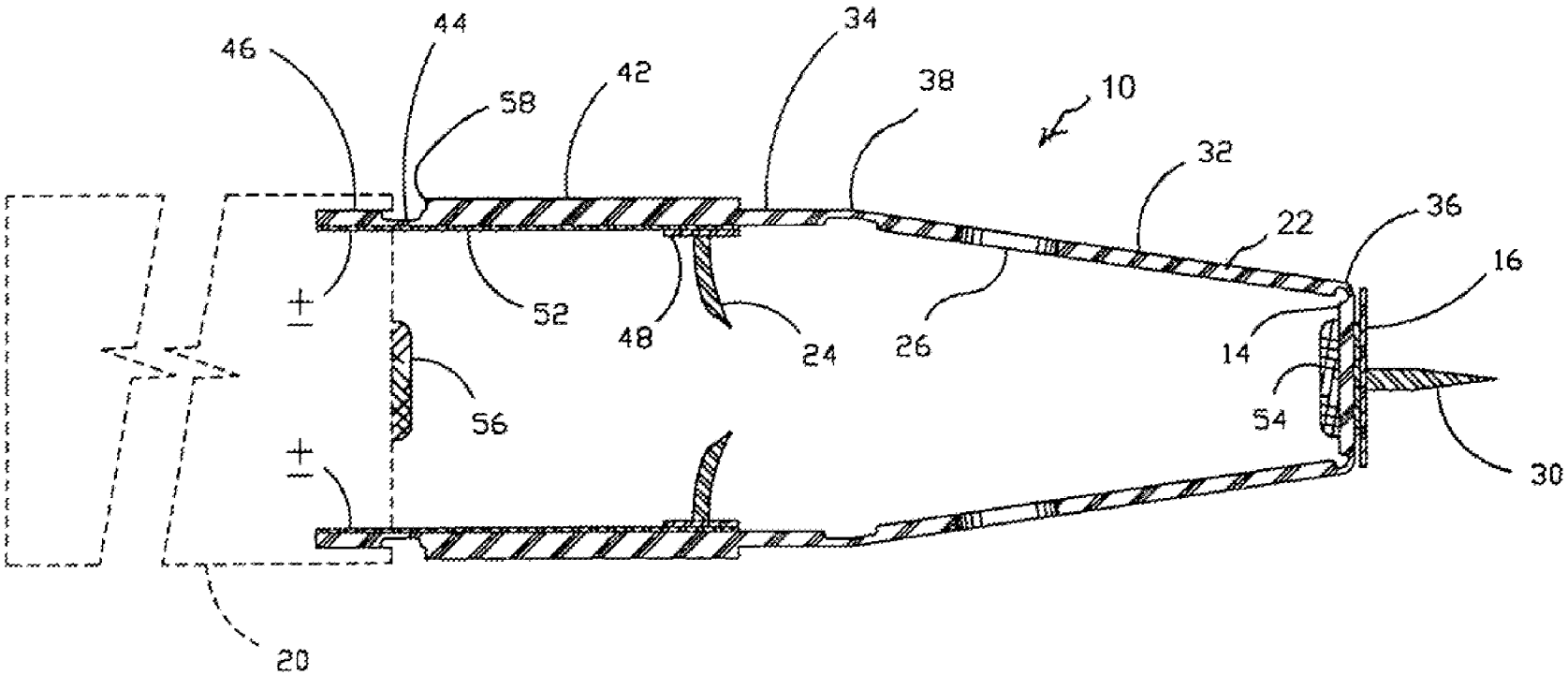
FIG. 3 is a cross-sectional view as taken across lines 3-3 of FIG. 1 showing, in particular, the manner in which the barbs and electrical conducting material are affixed to the interior of the attachment.

FIG. 3 is a cross-sectional view of the attachment 10 of the present invention. The sections 22 include a frontal segment 32 that is attached by a plastic hinge 36 to the strike plate 14. This frontal segment 32 incorporates the hole 26 therein. The frontal segment 32 is attached to the rear segment 34 by another hinge 38. An integral portion of the rear segment 34 is the reinforcing section 42. A seating notch 58 is illustrated toward the rear of the reinforcing section 42. Another plastic hinge 44 attaches the rear segment 34 to an insertion tab 46. The barb 24, along with its base 48, are adhered to an electrical conducting strip 52. A hook-and-loop material pad 54 is shown as adhered to the rear of the strike plate 14. Pad 54 is in alignment with a matching pad 56 of complementary hook-and-loop material. This matching pad 56 is adhered to the front of the cartridge 20 interior of the body of the attachment 10.

Figure 4:
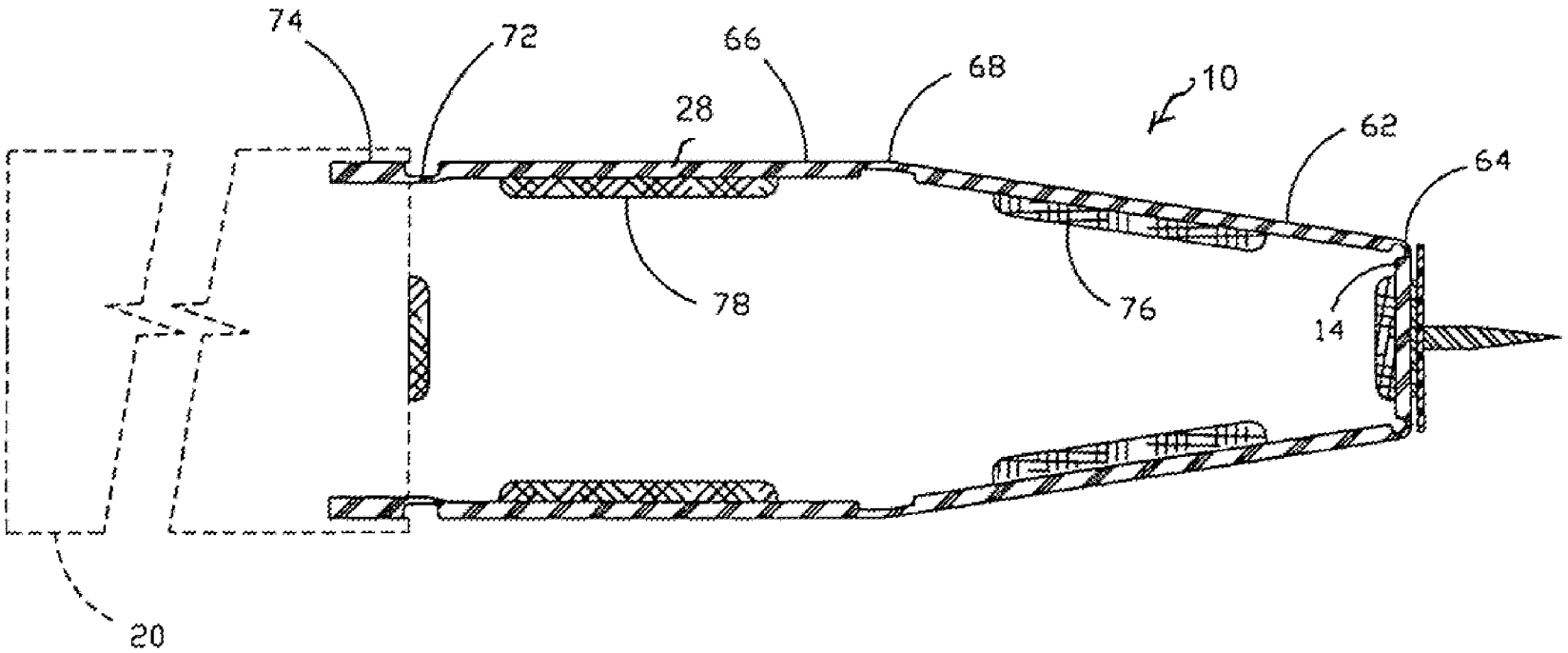
FIG. 4 is a cross-sectional view as taken across lines 4-4 of FIG. 1 showing the sections to which the hook-and-loop material are attached.

FIG. 4 is another sectional view of the attachment 10 of the present invention. As can be seen, there is a frontal segment 62 that is attached by a plastic hinge 64 to the strike plate 14. The frontal segment 62 is attached to a rear segment 66 by another hinge 68. The rear segment 66 is attached by a hinge 72 to an insertion tab 74. This rear segment 66, along with hinge 72 and insertion tab 74 are forcibly distorted into a curved shape when it is attached to the cartridge 20. This creates a stiffness in the segments 28 that act to maintain the shape of the attachment 10 before it strikes a target. When the attachment 10 strikes a target and begins to fold, the hinges 72 simply tear at the outer edges toward the center of the segment 28. This allows the attachment 10 to collapse against the target. A strip of hook-and-loop material 76 is attached to the inner surface of the frontal segment 62 and aligns with a mating strip of hook-and-loop material 78 which is attached to the rear segment 66 of section 28.

Figure 5:
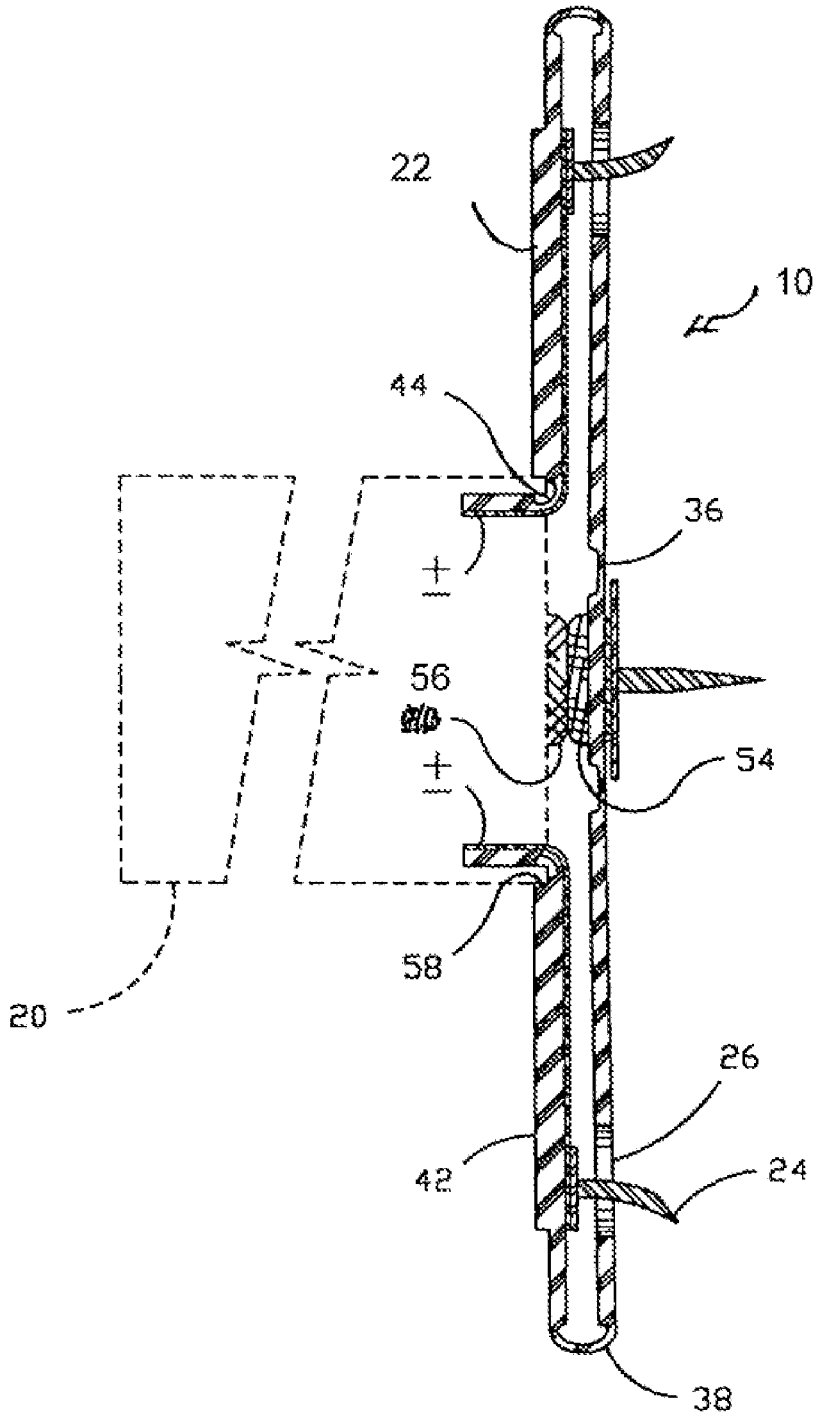
FIG. 5 is a cross-sectional view of the attachment of the present invention showing the attachment as configured upon impact with a target.

FIG. 5 is a similar sectional view as FIG. 3 but shows the attachment 10 as it appears after collapsing upon target impact. As can be seen, hinges 36, 38, and 44 will bend to allow this motion to occur. The barbs 24 have exited through the holes 26 to make contact with the target. These barbs 24 are positioned on sections 22 so that they will be approximately four inches apart on opposing sections after impact. The tabs 54 and 56 of hook-and-loop material make contact and are separably attached. The seating notch 58 makes contact with the cartridge 20 and allows the reinforcing section 42 to stiffen the sections 22 so as to allow more of the force of the cartridge 20 to be imparted to the barbs 24 upon impact.

Figure 6:
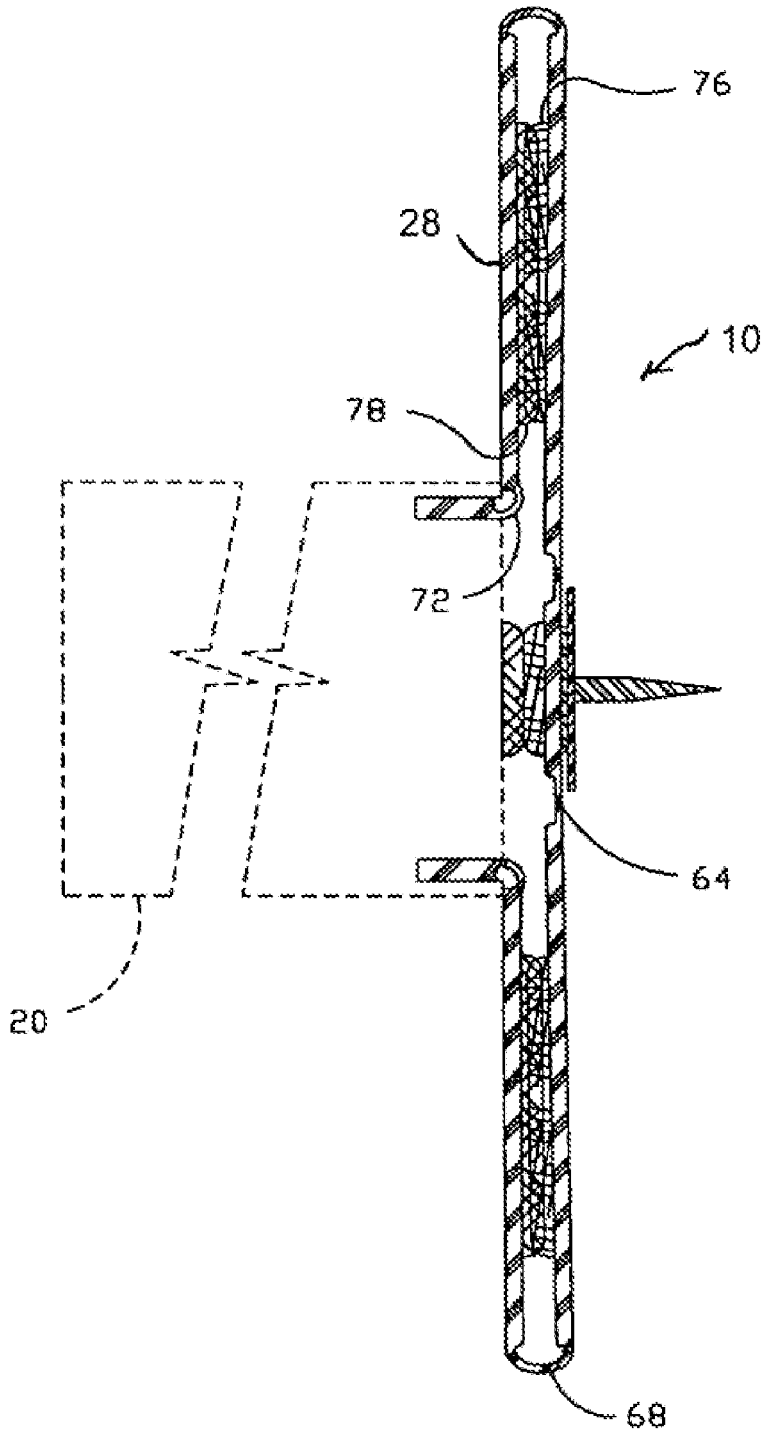
FIG. 6 is a cross-sectional view showing the configuration of the attachment of the present invention subsequent to impact.

FIG. 6 shows the attachment 10 as illustrated through sections 28 and, in particular, showing the attachment 10 collapsed as upon impact. FIG. 6 shows that the hinges 64, 68 and 72 suitably bend so as to allow the collapse of the attachment 10. These hinges and the hinges on sections 22 could be made thicker or thinner in order to change the impact characteristics of the cartridge 12. When the hinges are thicker or stiffer, less impact force will be delivered to the target by the cartridge 20. The hook-and-loop material strips 76 and 78 are illustrated as being separably adhered to one another.

Figure 7:
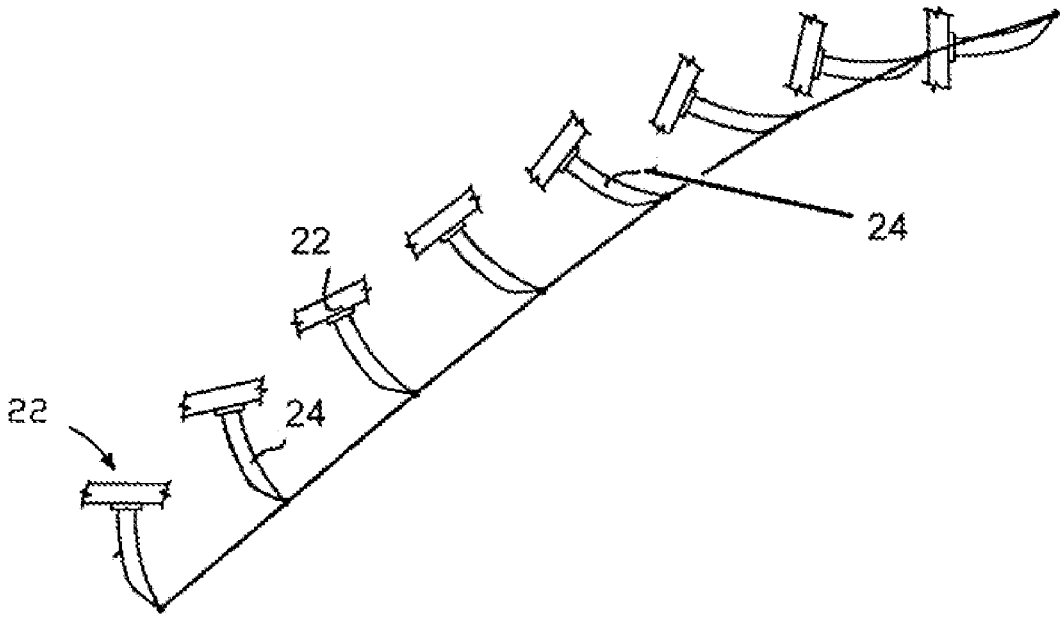
FIG. 7 is a diagrammatic illustration of the trajectory of the tip of the barb during and upon impact.

FIG. 7 is a diagrammatic illustration of the motion that tracks the tip of a barb of a segment barb 24. FIG. 7 illustrates how the angle of entry and barb 24 are aligned upon impact. This alignments prevents unnecessary damage by the barb 24 upon penetration. The angle of the barb 24, after penetration, combined with the locking action of the hook-and-loop material strips makes the attachment 10 less likely to fall off or be removed by untrained personnel, including the targeted person or animal.

Figure 8:
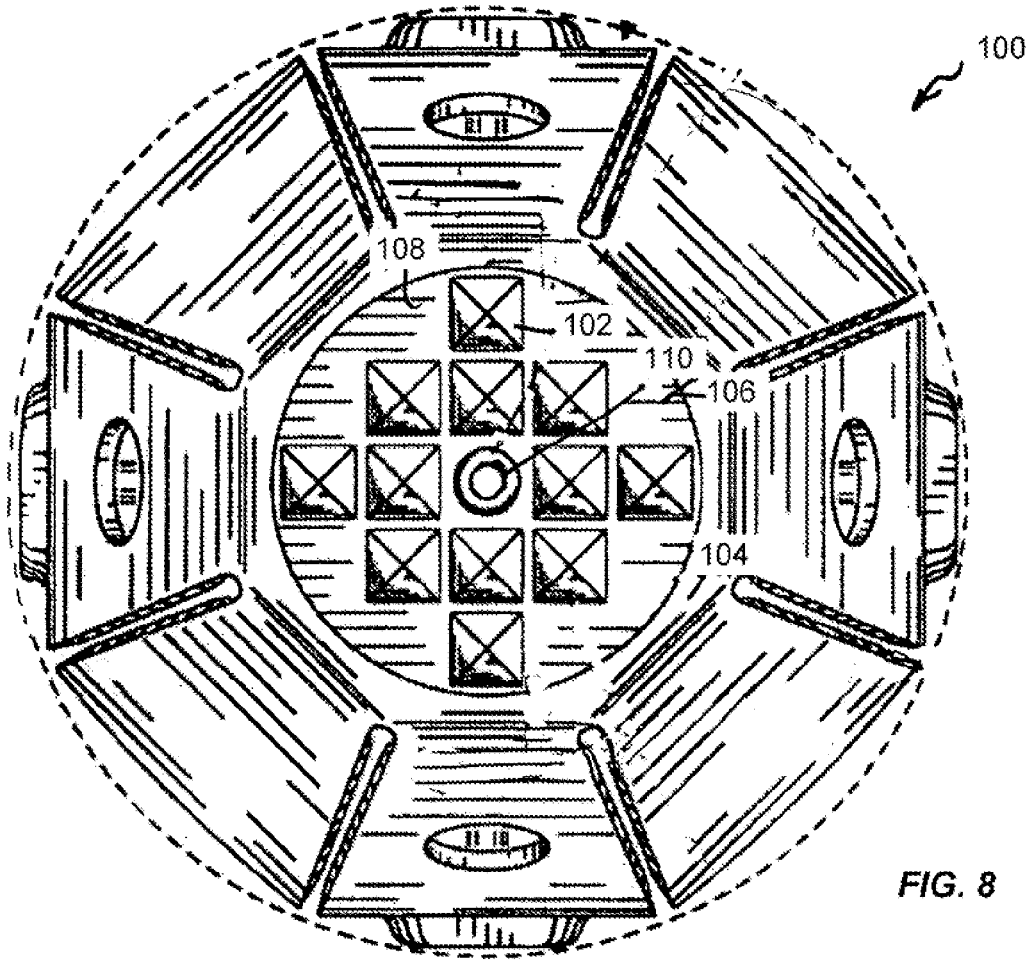
FIG. 8 shows a frontal view of an alternative embodiment of the present invention.
Figure 9:
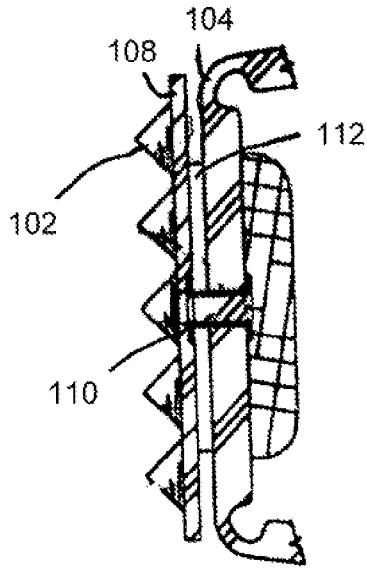
FIG. 9 is a view of the alternative embodiment of FIG. 8.

FIG. 8 shows an alternative embodiment of the attachment 100 of the present invention. In this embodiment, there is an array of rubber pyramids 102 which are used instead of a central barb of the previous embodiment of the present invention. These rubber pyramids 102 are located at the tip 104 of the attachment 100. The rubber pyramids allows the attachment 100 to avoid exposed sharp points. As a result, it may be easier to cartridge a round without the risk of puncture. Additionally, it may be easier to store the attachment 10 in a cartridge belt. The rubber pyramids 102 are placed on a front strike plate 106. The rubber pyramids 102 are integral with a disk base 108. The disk 108 is attached to the front strike plate 104 through a central rivet 110. A teflon washer 112 is located between the disk 108 and the front strike plate 104. The disk 108 is rotatable about the rivet 110 so as to limit the effect of torsional forces on the remainder of the attachment 100 until the barbs (described in association with the previous embodiment) enter the target. As can be seen in FIG. 9, the pyramids 102 extend outwardly of the disk 108. The rivet 110 will extend through the disk 108 and join with the strike plate 104. The teflon washer 112 is interposed between the disk 108 and the front strike plate 104.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An attachment to an electricity-inducing immobilization device comprising:

a plurality of converging sections having a rear end suitable for connection to the device;

a strike plate affixed to a front end of said plurality of converging sections;

a plurality of pyramid-shaped projections affixed to said strike plate and extending outwardly therefrom; and a hinging means formed on each of said plurality of converging sections, said hinging means for folding said plurality of converging sections when said strike plate contacts a target, said hinging means comprising:

a first hinge formed at said first end of the converging section adjacent said strike plate;

a second hinge formed generally centrally along the converging sections; and a third hinge formed at said rear end of the converging section.

2. The attachment of claim 1, said first hinge folding outwardly when said strike plate contacts the target, said second hinge folding inwardly when said strike plate contacts the target, said third hinge folding outwardly when said strike plate contacts the target.

3. The attachment of claim 1, further comprising:

a spike affixed to said strike plate and extending longitudinally outwardly therefrom.

4. An attachment to an electricity-inducing immobilization device comprising:

a plurality of converging sections having a rear end suitable for connection to the device;

a strike plate affixed to a front end of said plurality of converging sections;

a hinging means formed on each of said plurality of converging sections, said hinging means for folding said plurality of converging sections when said strike plate contacts a target, said hinging means comprising:

a first hinge formed at said first end of the converging section adjacent said strike plate;

a second hinge formed generally centrally along the converging sections; and a third hinge formed at said rear end of the converging section;

electricity conducting means formed along said plurality of converging sections, said electricity conducting means for delivering an electrical charge from the device to the target.

5. The attachment of claim 4, further comprising:

a barb connected to an inner surface of at least one of said plurality of converging sections, said electricity conducting means connected to said barb, said barb movable outwardly of the converging section when said strike plate contacts the target.

6. The attachment of claim 5, the converging section having a hole formed therethrough, said barb extending outwardly through said hole when said strike plate contacts the target.

7. The attachment of claim 4, further comprising:

a securing means affixed to an interior of said plurality of converging sections, said securing means for retaining said plurality of converging sections in the folded arrangement after the strike plate contacts the target.

8. The attachment of claim 7, each of said plurality of converging sections comprising:

a first segment having an end connected to said strike plate; and a second segment hingedly connected said first segment, said securing means having a first hook-and-loop material affixed to an inner surface of said first segment and a second hook-and-loop material affixed to an inner surface of said second segment, said first and second hook-and-loop materials being complementary to each other.

9. An attachment to an electricity-inducing immobilization device comprising:

a plurality of converging sections having a rear end suitable for connection to the device;

a strike plate affixed to a front end of said plurality of converging sections;

a hinging means formed on each of said plurality of converging sections, said hinging means for folding said plurality of converging sections when said strike plate contacts a target, said hinging means comprising:

a first hinge formed at said first end of the converging section adjacent said strike plate;

a second hinge formed generally centrally along the converging sections; and a third hinge formed at said rear end of the converging section;

a hook-and-loop material affixed to a backside of said strike plate; and a complementary hook-and-loop material affixed to an interior of said plurality of converging sections, said hook-and-loop materials engaging each other after said strike plate contacts the target.

10. An attachment to an electricity-inducing immobilization device comprising:

a body having a plurality of sections extending along side of said body, said body having an end suitable for attachment to the device;

a strike plate affixed to an opposite end of said body, each of said plurality of sections being collapsible when the strike plate contacts a target;

a barb affixed to an inner surface of at least one of said plurality of sections; and an electricity conducting means connected to said barb for transmitting electricity to said barb, said barb being movable outwardly of the section when said strike plate contacts the target.

11. The attachment of claim 10, at least one of said plurality of sections comprising:

a first segment having an end hingedly connected to said strike plate; and a second segment hingedly connected to said first segment, said barb affixed to the inner surface of said second segment, said first segment having a hole formed therethrough, said barb extending through said hole when said strike plate contacts the target.

12. The attachment of claim 11, another of said plurality of sections comprising:

a first segment having an end connected to said strike plate;

a second segment hingedly connected to said first segment, said first segment having a first hook-and-loop material affixed to an inner surface thereof, said second segment having a second hook-and-loop material affixed to an inner surface thereof, said first and second hook-and-loop materials being complementary to each other.

13. The attachment of claim 11, said second segment having a hinge at said end opposite the hinge connection with said first segment.

14. The attachment of claim 11, each of said plurality of sections having a first segment converging toward said strike plate, said strike plate having a pointed element extending longitudinally outwardly therefrom.

15. The attachment of claim 11, further comprising:

a hook-and-loop material affixed to a backside of said strike plate; and a complementary hook-and-loop material affixed to an interior of said body, said hook-and-loop materials engaging each other after said strike plate contacts the target.

* * * * *